United States Patent [19]

Zurcher

[11] 3,989,076

[45] Nov. 2, 1976

[54] PULP CHIP FORMING CROSSCUT SAWS

[75] Inventor: James H. Zurcher, Roseburg, Oreg.

[73] Assignee: Pacific Saw and Knife Company, Portland, Oreg.

[22] Filed: Feb. 18, 1975

[21] Appl. No.: 550,834

[52] U.S. Cl. ..... 144/42; 83/8; 144/162 R; 144/323; 144/326 B

[51] Int. Cl.[2] ..... B27C 1/14

[58] Field of Search..... 83/8; 144/1 R, 42, 162 R, 144/230, 231, 309 R, 321, 322, 323, 326, 43, 326 A, 326 B, 326 C

[56] References Cited

UNITED STATES PATENTS

| | | | |
|---|---|---|---|
| 2,449,605 | 9/1948 | Kelton | 144/230 |
| 2,789,806 | 4/1957 | Buttrick | 144/230 X |
| 2,876,811 | 3/1959 | Matthews | 144/162 R |

*Primary Examiner*—Othell M. Simpson
*Assistant Examiner*—W. D. Bray
*Attorney, Agent, or Firm*—Klarquist, Sparkman, Campbell, Leigh, Hall & Whinston

[57] ABSTRACT

One pulp chip forming crosscut saw includes a saw chain including a U-shaped combined side slitter and raker tooth and a depth gauge carrying a center slitter tooth extending above the side slitter and raker tooth so that the center slitter tooth slits the center of the bottom of the kerf and then the side slitter and raker tooth cuts two rows of pulp chips. A second pulp chip forming crosscut saw includes a carrier member supporting a U-shaped tooth having side slitting side plates and a raker top plate which carries on the top thereof a center slitter. Another pulp chip forming crosscut saw includes a solid block, sloping faced raker having a center slitter on the top thereof and mounted by an undercut interlock on a carrier. Another pulp chip forming crosscut saw includes a solid block, a sloping faced raker carrying a center slitter on its top and a pair of side slitters at the sides of the block. A further embodiment comprises a saw chain having left and right bonded cutters mounted at the same point along the chain with the top plates of each extending about halfway across the kerf.

7 Claims, 8 Drawing Figures

PULP CHIP FORMING CROSSCUT SAWS

DESCRIPTION

This invention relates to pulp chip forming crosscut saws and has for an object thereof the provision of crosscut saws adapted to form merchantable pulp chips.

Another object of the invention is to provide a saw chain adapted to form pulp chips.

A further object of the invention is to provide a circular crosscut saw adapted to form pulp chips.

Another object of the invention is to provide a saw chain having side slitters slitting two sides of a kerf to a predetermined depth, a center slitter slitting the bottom of the kerf to a greater depth and a raker raking the kerf to said predetermined depth.

Another object of the invention is to provide a saw chain having a cutter link having a U-shaped side slitting and raker cutter and a depth gauge link having a depth gauge and a center slitter.

Another object of the invention is to provide a crosscut saw having a U-shaped tooth forming combined raker and side slitters with a center slitter on a top plate of the tooth.

Another object of the invention is to provide a crosscut saw having a solid raker tooth with a sloping, sharpenable forward face and a center slitter on the top of the raker.

Another object of the invention is to provide a crosscut saw having a tooth including two side slitters with a solid block, sloping face raker between and rearwardly of the cutting edges of the slitters, and a center slitter on the top of the block.

Another object of the invention is to provide a pulp-chip forming saw chain having center slitters and allochiral hooded cutters each having a raker extending to the center slit formed by the center slitters.

Figure 1:
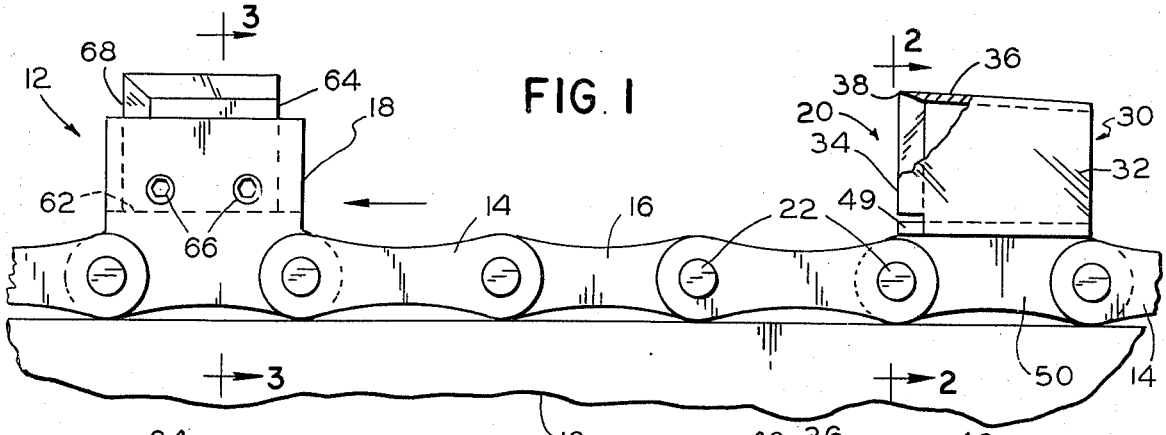
FIG. 1 is a fragmentary, side elevation view of a chain saw including a bar and a pulp chip forming saw chain forming one embodiment of the invention.
Figure 3:
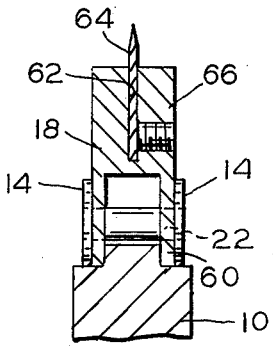
FIG. 3 is a vertical sectional view taken along line 3—3 of FIG. 1.
Figure 2:
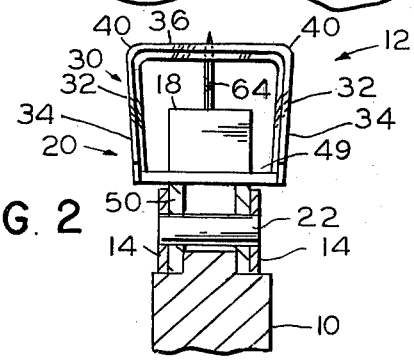
FIG. 2 is a vertical sectional view taken along line 2—2 of FIG. 1.
Figure 7:
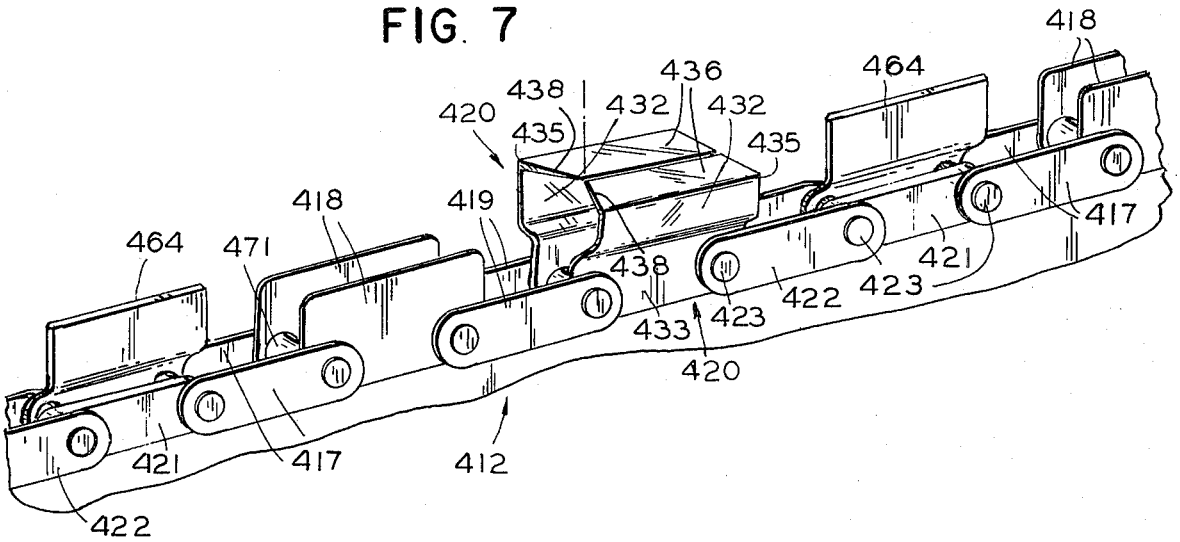
Figure 8:
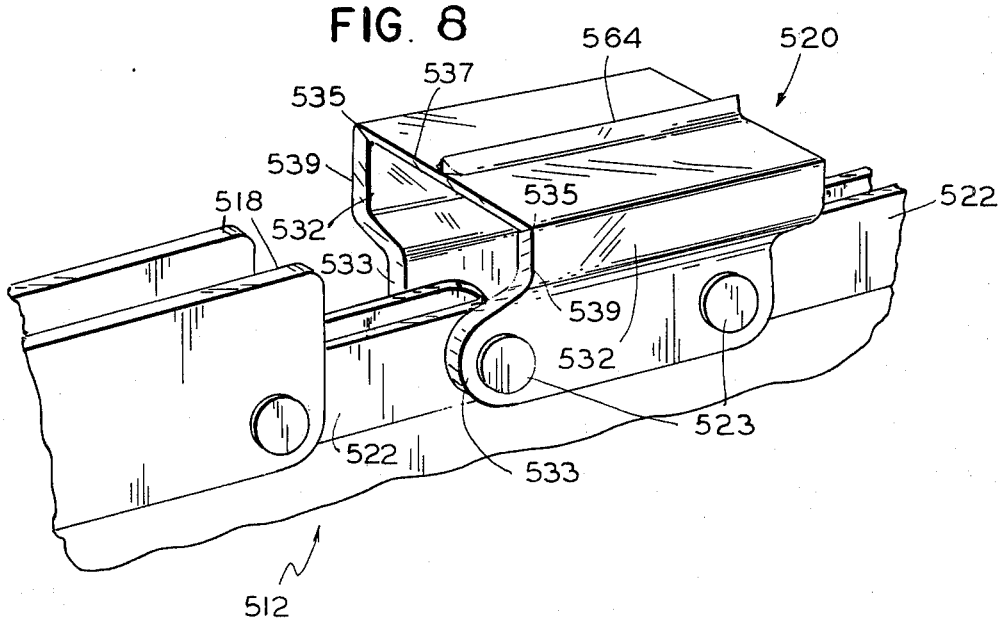

FIG. 7 is a fragmentary, perspective view of a pulp chip forming saw chain forming an alternate embodiment of the invention; and, FIG. 8 is a fragmentary, perspective view of a pulp chip forming saw chain forming an alternte embodiment of the invention. Referring now in detail to the drawings, there is shown in FIGS. 1–3 a chain saw including a conventional saw bar 10 and a pulp chip forming saw chain 12 forming one specific embodiment of the invention. The saw chain is a carrier means, is, of course, endless, and includes side links 14, center links 16, depth gauges 18 and combined sides slitting and raker links 20, rivets or pins 22 joining the several links pivotally together, a full sequence being shown in FIG 1.

Each of the combined sides slitting and raker links 20 includes a generally U-shaped or hooded cutter 30 of tough, hard steel including side slitting plates 32 having bevelled, sharpenable, forwardly located cutting edges 34. A top plate 36 has a bevelled, sharpenable, forwardly located cutting edge 38, and small radius, bevelled, sharpenable, corner cutting edges 40 join the cutting edges 34 and 38. The cutting edges 40 shown are of chipper configuration to enable them to be sharpened by a small, round file, but, if desired, they can be of sharp cornered, or chisel configuration. The side slitting and top plates taper inwardly slightly proceeding from front to rear to provide relief. The side plates 32 also are sloped slightly inwardly proceeding downwardly to provide relief. The lower end portions of the side slitting plates 32 are rigidly secured, as by welding, to a plate 49 of linking plates 50 pivotally connected to pairs of the side links 14 and guided by spaced lateral guides (not shown) in the saw bar 10 as is well known in the art.

Each of the depth gauges 18, which are of block form, has side link portions 60 and also has an upper center slot 62 in which a center slitter 64 is rigidly secured by set screws 66. The center slitter 64 has a sharpenable cutting edge 68 located precisely midway between the side slitting edges 34 of the side slitting plates 32, and the cutting edge 68 extends upwardly from the top or gauging surface of the depth gauge 18 a distance slightly greater than the depth of cut by the top plate 36 just behind. Thus, as the saw chain is advanced along a kerf from right to left, as viewed in FIG. 1, the center slitter 64 cuts a center cut in the kerf and the following tooth 30 cuts the sides of the kerf and rakes two separate rows of chips out of the kerf bottom, each of the rows of chips being of the same width. Each of the two rows of chips is preferably about three-quarters of an inch wide and the thickness of each row is about one-eighth of an inch. The rows of chips curl and break up into chips shortly after leaving the cutting edge 38, and travel easily through the tooth 30, the cut being a crosscut transverse to the grain of the wood.

EMBODIMENT OF FIG. 4

A pulp chip forming crosscut saw 110 forming an alternate embodiment of the invention includes spaced cutters 130 secured rigidly to mounting plates 149 having dovetails 151 clamped by clamps 153 locked in undercut notches 155 in a circular saw disc or endless carrier means 157, bolts 159 pulling up the pairs of clamps. Each cutter 130 is like the cutter 30 except that a top plate 136 of the cutter 130 has a center slitter 164 integral therewith that slits the bottom of the kerf midway between side slitting edges 134 to a depth somewhat deeper than the depth the next succeeding cutter cuts into the bottom of the kerf. It will be appreciated that the cutters 130 can be used on a saw chain merely by securing them to links like the links 50.

EMBODIMENT OF FIG. 5

A pulp chip forming crosscut saw 210 forming an alternate embodiment of the invention includes a solid block raker 230 having a sloping face 231 and a raking edge 238. The raker 230 is secured to a circular saw disc or endless carrier means 257 by clamps 253. A center slitter 264 is integrally mounted on the top of the raker 230. Side slitting plates 232 are similarly mounted on the saw disc 257 in advance of each raker. Sharpening of the raker cutting edge 238 can be effected by filing the face 231. The rakers 230 can, of course, be substituted for the cutters 30 of the saw chain 12. The top of each raker 230 and the center slitter 264 may be slightly sloping.

EMBODIMENT OF FIG. 6

A pulp chip forming cross cut saw 310 forming an alternate embodiment of the invention is similar to the saw 210, but, in addition to solid block raker 330, has side slitting plates 332 secured to the block raker 330 by screws 335. The teeth including the rakers 330 and the pairs of side slitting plates 332 are secured in spaced positions to circular saw disc or endless carrier means 357 by clamps 353 and bolts 359.

EMBODIMENT OF FIG. 7

A pulp chip forming saw chain 412 forming an alternate embodiment of the invention includes, in each sequence thereof, a center slitter 464, side links 417, a pair of side-by-side depth gauges 418, links 419 and a pair of side-by-side allochiral, hooded cutters 420 and connecting links 421 and a pair of connecting links 422, all secured by rivets 423. If desired, a pair of depth gauges (not shown) like the depth gauges 418 but higher, may be substituted for the connecting links 422. The cutters 420 are of the chisel type, but may, of course, be of chipper type, and include side slitter portions 432 and top plates 436 having top cutting edges 433. The top plates extend laterally almost to the center of the chain. The top plates and side slitter portions slope somewhat to the rear for clearance and the side slitter portions slope slightly inwardly proceeding downwardly for clearance. The cutters have lower, link portions 433, which are positioned inwardly from outermost corners 435 of the cutters and are secured by rivets 423 to the center or drive links 421.

The center slitters 464 cut the bottom of kerf to a depth somewhat greater than the chips to be removed and then the cutters 420 side slit and rake to cut the chips. Each pair of cutters is, in effect, a split cutter and, being split, aid in chip flow. It is preferred that each pair of the cutters 420 are side-by-side, but they can be staggered from each other lengthwise of the chain for even greater chip clearance. The pairs of depth gauges 418 are connected rigidly to tubes 471 and form rigid units therewith serving as drive links, rivets 423 extending through the tubes.

EMBODIMENT OF FIG. 8

A pulp chip forming saw chain 512 forming an alternate embodiment of the invention is similar to the saw chain 412 but includes single, generally U-shaped cutters 520 of the chisel type connected by rivets 523 to drive links 522 and depth gauge links 518 like the links 418. Each cutter includes a top plate 536 having a center slitter 564 and a raker cutting edge 537. Side slitters 532 have side slitting edges 539 joining the edge

537 at sharp corners 535. Inset lower links portions 533 are connected by the rivets 523 to the drive links. The cutters 520 may be made by forming and swaging or they may be cast. The cutters 520, while disclosed as chisel type, may, of course, be of the chipper type.

Figure 4:
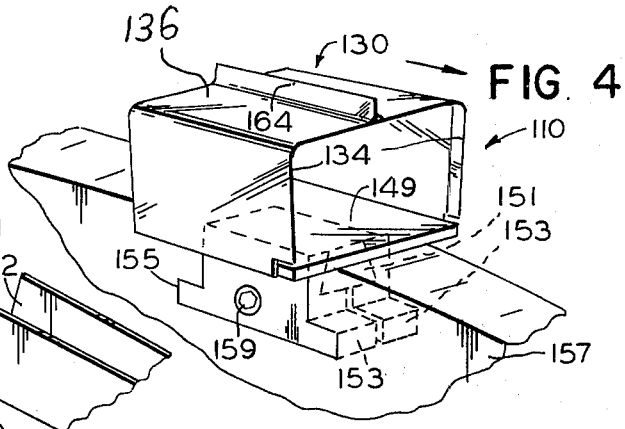
FIG. 4 is a fragmentary, perspective view of a pulp chip forming crosscut saw forming an alternate embodiment of the invention.
Figure 5:
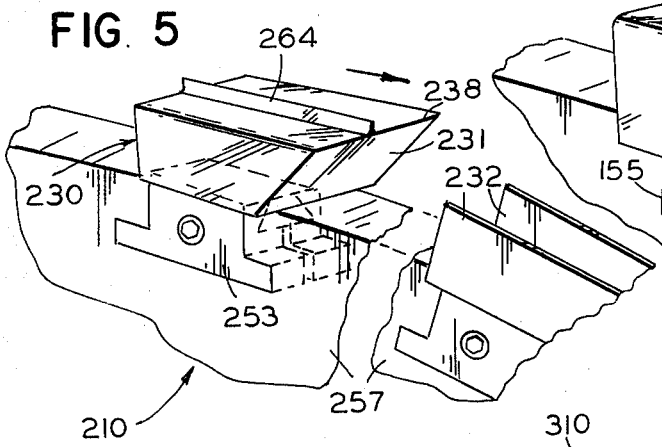
FIG. 5 is a fragmentary, perspective view of a pulp chip forming crosscut saw forming an alternate embodiment of the invention.
Figure 6:
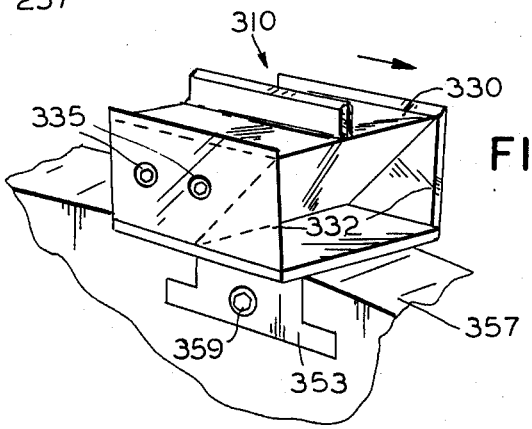
FIG. 6 is a fragmentary, perspective view of a pulp chip forming crosscut saw forming an alternate embodiment of the invention.

The above-described saws comprising the saw chains 12, 412 and 512 and the crosscut saws, effect crosscuts and, in so doing, form merchantable pulp chips. They are useful whenever cross-cutting is needed, and are especially useful in bucking and squaring ends of peeler logs, the saws cutting a kerf of one-and-one-half inches with no waste while previously, with conventional cross-cutting, a kerf of from one-half to three-quarters of an inch is made with all of the kerf being sawdust, which is essentially waste. In the saws forming the embodiments of FIGS. 4–6, it will be understood that depth gauges are provided between each consecutive pair of raker elements to limit the depth of cut.

I claim:

1. In a pulp chip forming saw, endless carrier means adapted to be moved in a predetermined direction, pairs of side slitting plates mounted on the carrier means in spaced positions for cutting the sides of a kerf, a plurality of raker means mounted between the side slitting plates and each extending substantially completely across the kerf for raking pulp chips out of the kerf, a plurality of center slitters each positioned in advance of one of the raker means and substantially centered relative to the raker means, and a plurality of depth gauge means mounted on the carrier means in advance of the raker means.

2. The pulp chip forming saw of claim 1 wherein the center slitters are mounted on the depth gauge means.

3. The pulp chip forming saw of claim 2 wherein the endless carrier means is chain.

4. The pulp chip forming saw of claim 1 wherein the side slitting plates and the raker means are integral.

5. The pulp chip forming saw of claim 4 wherein each pair of side slitting plates and the raker means define a hooded cutter having a top plate.

6. The pulp chip forming saw of claim 5 wherein the hooded cutters have rounded, chipper corners at the junctures of the cutting edges of the slitting plates and the top plates.

7. In a pulp chip forming saw, endless carrier means adapted to be moved in a predetermined direction, a plurality of hooded cutter means including side slitters, raking top plates, and inset link portions, mounted on the carrier means in spaced positions therealong, each hooded cutter means being generally U-shaped and forming a chip passage therethrough, and a plurality of depth gauges mounted on the carrier means in advance of the cutter means.

* * * * *

UNITED STATES PATENT OFFICE

CERTIFICATE OF CORRECTION

PATENT NO. : 3,989,076

DATED : November 2, 1976

INVENTOR(S) : James H. Zurcher

It is certified that error appears in the above-identified patent and that said Letters Patent are hereby corrected as shown below:

Abstract - third line from bottom of abstract, change "bonded" to --hooded--;

Column 1, line 60, change "alternte" to --alternate--;

Column 1, line 61, "Referring now in detail to the" should be the start of a new paragraph;

Column 3, line 31, change "433" to --438--

Column 4, claim 3, line 2, insert --a-- after "is"

Signed and Sealed this

Eleventh Day of January 1977

[SEAL]

*Attest:*

RUTH C. MASON
*Attesting Officer*

C. MARSHALL DANN
*Commissioner of Patents and Trademarks*